US011357350B2

(12) United States Patent
Butler

(10) Patent No.: US 11,357,350 B2
(45) Date of Patent: Jun. 14, 2022

(54) ECO FRIENDLY MAILBOX

(71) Applicant: Sabrina Butler, Tamarac, FL (US)

(72) Inventor: Sabrina Butler, Tamarac, FL (US)

( * ) Notice: Subject to any disclaimer, the term of this patent is extended or adjusted under 35 U.S.C. 154(b) by 283 days.

(21) Appl. No.: 16/794,195

(22) Filed: Feb. 18, 2020

(65) Prior Publication Data

US 2020/0281383 A1 Sep. 10, 2020

Related U.S. Application Data

(60) Provisional application No. 62/807,059, filed on Feb. 18, 2019.

(51) Int. Cl.

| | |
|---|---|
| ***A47G 29/124*** | (2006.01) |
| ***B02C 18/00*** | (2006.01) |
| ***A47G 29/122*** | (2006.01) |
| ***A47G 29/12*** | (2006.01) |

(52) U.S. Cl.

CPC ..... *A47G 29/1251* (2017.08); *A47G 29/122* (2013.01); *A47G 29/1209* (2013.01); *B02C 18/0007* (2013.01); *B02C 2018/0046* (2013.01)

(58) Field of Classification Search

CPC ..... A47G 29/1251; A47G 29/122; A47G 29/1209; A47G 29/12095; A47G 2029/1257; B65G 2201/0285; B02C 18/0007; B02C 2018/0046

USPC ..... 232/17, 43.1, 43.3, 43.5, 45; 193/8; 83/167; 241/100, 236

See application file for complete search history.

(56) References Cited

U.S. PATENT DOCUMENTS

| | | | | |
|---|---|---|---|---|
| 7,516,880 | B1 * | 4/2009 | Crain | B02C 18/0007 232/45 |
| 8,025,246 | B1 * | 9/2011 | Brown | B02C 18/16 241/100 |
| 2007/0295843 | A1 * | 12/2007 | Smith | B02C 18/0007 241/101.01 |
| 2009/0261189 | A1 * | 10/2009 | Ellis, Jr. | B02C 18/0007 241/36 |
| 2017/0326598 | A1 * | 11/2017 | Chelian | A47G 29/1214 |

FOREIGN PATENT DOCUMENTS

| | | | |
|---|---|---|---|
| CN | 108125525 A | * | 6/2018 |
| CN | 108209496 A | * | 6/2018 |

* cited by examiner

*Primary Examiner* — William L Miller
(74) *Attorney, Agent, or Firm* — Calrie Marsh, Esq.

(57) ABSTRACT

An ecologically sound and environmentally friendly mailbox apparatus comprising a traditional mailbox; a shredding device affixed to the underside of the mailbox; a hollow tube, having a first end and a second end; a hollow receptacle for collecting shredded material, and that is connected to the shredding device by way of the hollow tube, where the first end of the hollow tube is connected to the shredding device and the second end of the hollow tube is directed downward and is connected to the receptacle; and a vertically positioned pole located adjacent to the mailbox and the receptacle, whereby the mailbox and the receptacle are individually connected to the pole by a fastening means that holds the entire apparatus together. This apparatus allows an end user to shred junk mail before leaving his mailbox and prevent clutter in his home.

8 Claims, 4 Drawing Sheets

ECO FRIENDLY MAILBOX

STATEMENT REGARDING FEDERALLY SPONSORED RESEARCH OR DEVELOPMENT

This invention has been created without the sponsorship or funding of any federally sponsored research or development program.

FIELD OF INVENTION

The present invention relates generally to mailboxes designed to be ecologically sound and environmentally friendly.

BACKGROUND

We all receive junk mail on a daily basis which clutters our mailboxes, our kitchen counters, our dining tables, and even our living room furniture. We tend to receive this mail and bring it inside our dwelling with the intention to shred or throw it out, but seem to never get around to it until it becomes a mountain or a giant mess. Thus far, the traditional mailbox has remained one dimensional in function, i.e. serves as a receptacle for the deposit or retrieval of mail. The traditionally mailbox does not serve the function of reducing or eliminating junk mail in an environmentally responsible manner.

SUMMARY OF INVENTION

The present invention aims to provide a "Green Box" which is essentially a mailbox with additional components for reducing and eliminating junk or unwanted mail in an ecologically and environmentally conscious manner. The present invention includes a traditional mailbox with a shredding device affixed to it, and having a tube or pathway which is attached at one end to the shredding device and at the other end is attached to a receptacle for collecting the shredded paper for disposal by way of recycling or the trash. These additional components would be securely attached to the mailbox and each other in an optimal arrangement to withstand the natural elements and/or man-made/induced hazards.

The present invention adds another dimension and functionality to a standard or traditional mailbox, combining existing components in a novel way in order to dispose of junk mail and the like in an ecologically sound or environmentally friendly way.

DESCRIPTION OF THE INVENTION

Before the subject invention is described further, it is to be understood that the invention is not limited to the particular embodiments of the invention described below, as variations of the particular embodiments may be made and still fall within the scope of the invention. It is also to be understood that the terminology employed is for the purpose of describing particular embodiments and is not intended to be limiting.

The details of one or more embodiments of the invention are set forth in the accompanying drawings and the description below. Other features, objects, and advantages of the invention will be apparent from the description and drawings, and from the claims. In the following description, numerous specific details are set forth to provide a thorough understanding of the embodiments. One skilled in the art to which this invention belongs will recognize, however, that the techniques described can be practiced without one or more of the specific details, or with other methods, components, materials, etc. In other instances, well known structures, materials or operations are not shown or described in detail to avoid obscuring certain aspects.

In this specification, the singular forms "a," "an" and "the" include plural reference unless the context clearly dictates otherwise. Unless defined otherwise, all technical and scientific terms used herein have the same meaning as commonly understood to one of ordinary skill in the art to which this invention belongs.

Figure 1:
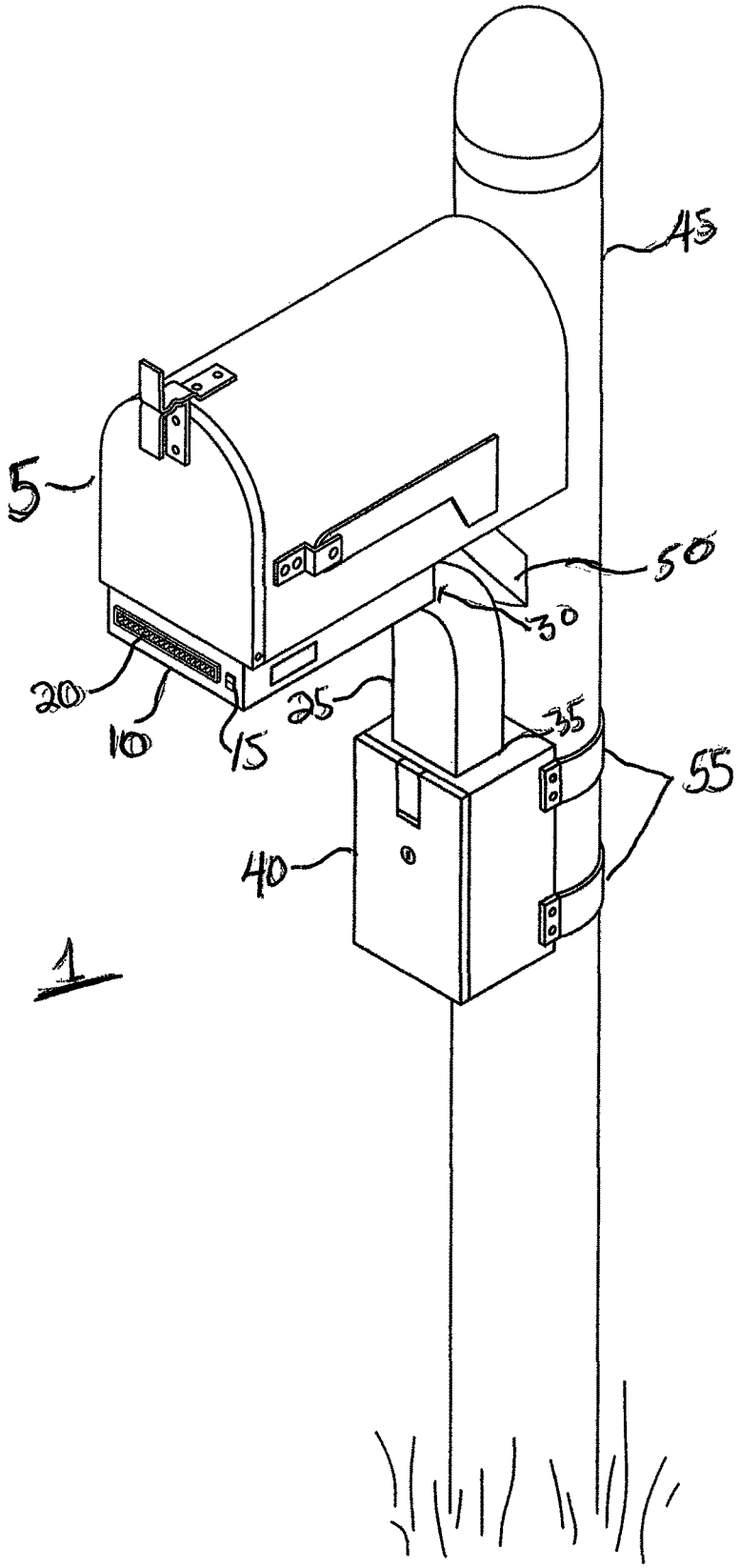
FIG. 1 illustrates the components of the present invention as assembled for carrying out the stated function.

As shown in FIG. 1, the present invention 1 comprises the following components: a traditional mailbox 5; a small shredding device 10 affixed to the underside of the mailbox 5; a hollow tube 25 having a first end 30 connected to the small shredding device 10 and a second end 35 directed downward away from the small shredding device 10; a receptacle 40 connected to the second end 35 of the tube; and a vertically positioned solid pole or beam 45 whereby the mailbox 5 and small shredding device 10 are securely connected to said pole or beam 45 by a connecting post 50, and the receptacle 40 is securely fastened by fastening means 55.

The shredding device 10 has a start/stop button 15 and cutters 20, which may be cross-cutters or strip-cutters. Also, the receptacle 40 has a locking or other security feature, including but not limited to lock-key setup, digital locks, biometrically enable locking mechanism and the like, to guard against theft, vandalism or the natural elements getting to the contents of the receptacle 40.

Figure 2:
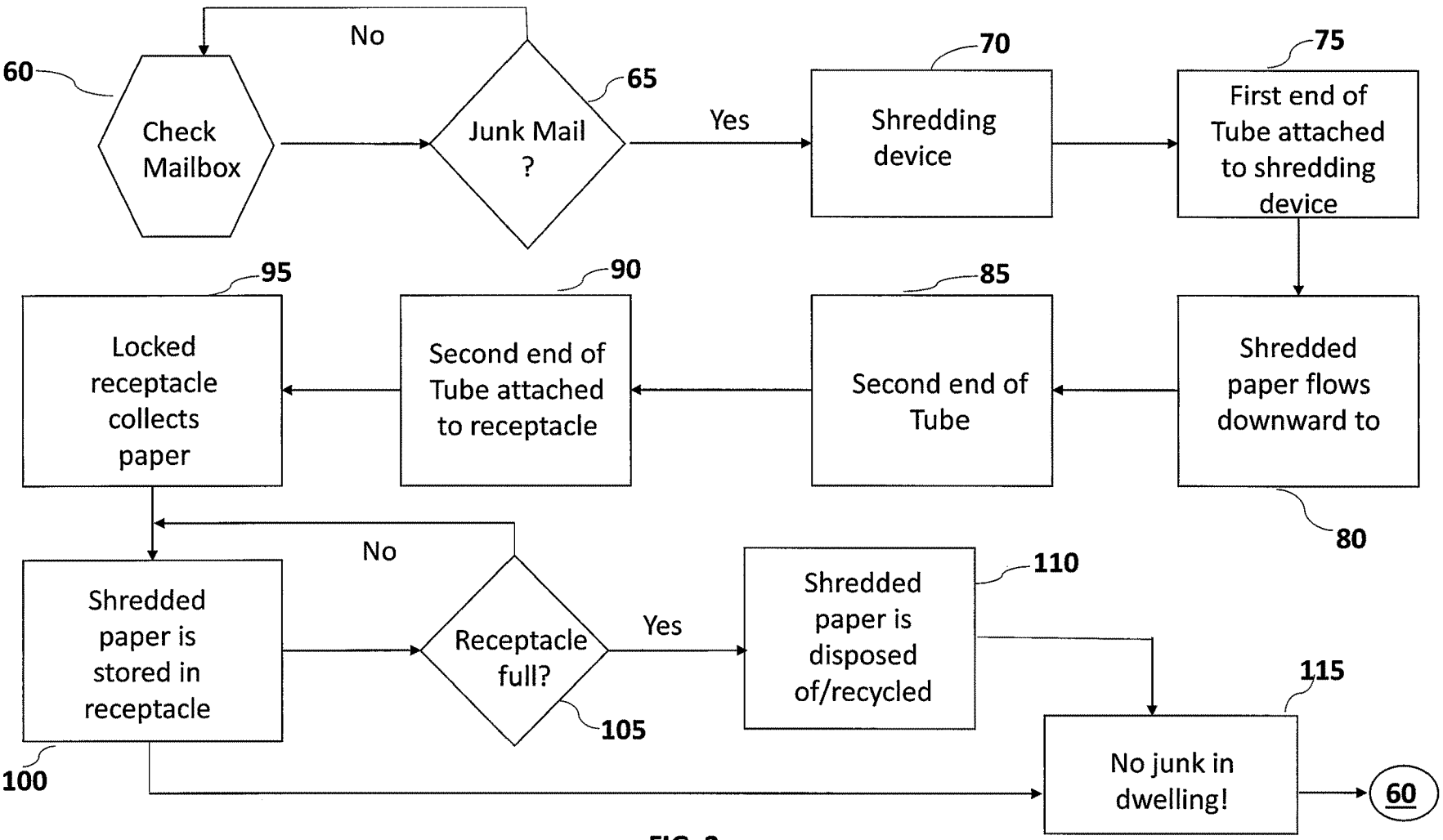
FIG. 2 is a flow diagram demonstrating the sequence of steps for accomplishing the stated function of the invention.

As illustrated in FIG. 2, the flow chart outlines how the present invention is used by an end user. At the start point block 60, the end user initiates the process by checking the mailbox 5, and determines whether or not there is junk mail at block 65. If there is no junk mail, then the process goes back to the start point block 60. If there is junk mail, then the end user proceeds to block 70 where the end user undertakes the shredding process which continues in sequence to blocks 75, 80, 85, and then 90 as shredded paper moves through the tube 25 and the process continues to block 95 where the paper is collected in the locked receptacle 40. The next step in the process is at block 100 where the shredded paper is stored in the locked receptacle 40. Then at block 105 the end user must determine whether the locked receptacle is full, and if it is not full, then the contents of the locked receptacle are stored therein—the process returns to block 100 which achieves the end goal of no junk mail in the end user's dwelling as represented by block 115. If at block 105, the end user determines that the locked receptacle is full of junk mail, then the process continues to block 110 where the shredded paper is disposed of or removed from the locked receptacle by either being trashed or recycled, which results in no junk mail in the end user's dwelling as represented at block 115. The process is repeated as often as desired by the end user who starts over by checking her mailbox at block 60.

Figure 3:
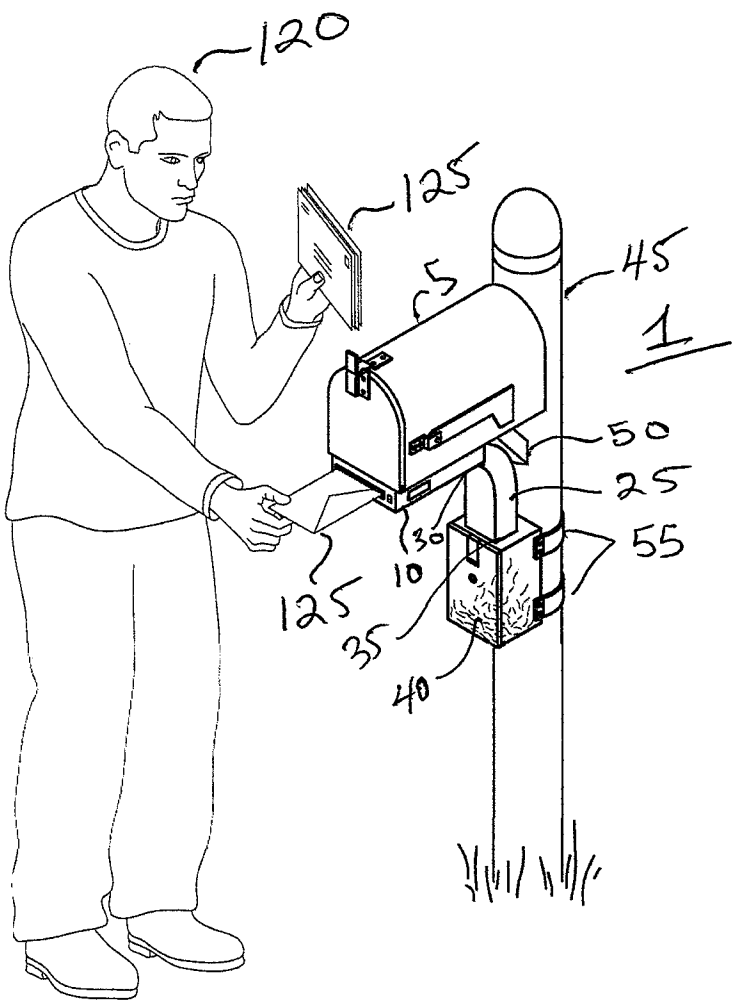
FIG. 3 illustrates the present invention as it is designed to function when used by an end user.
Figure 4:
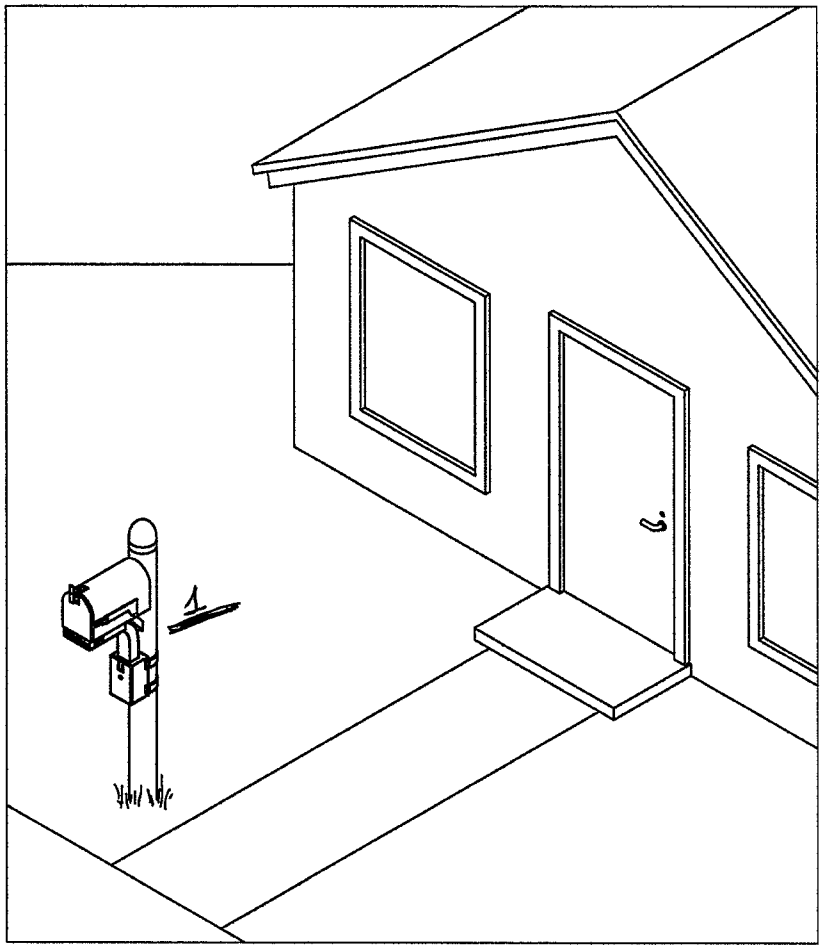
FIG. 4 illustrates the present invention as it is usually positioned in front of an end user's home.

FIG. 3 shows an end user 120 using the present invention 1 as it is designed to function and according to the process outlined in the flow chart of FIG. 2. The end user 120 has checked the mailbox 5 and finding junk mail 125, inserts it into the cutter portion 20 of the shredding device 10 located on the underside of the mailbox 5. The shredded paper of the junk mail 125 passes through the tube 25 down into the locked receptacle 40 where the paper is collected, stored, then disposed of at a later time or date. The end user 120 has the ability to control whether or not junk mail is carried into his or her dwelling by having the convenience of the apparatus of this invention 1 situated within close proximity to the dwelling as shown in FIG. 4. The end user 120 is then able to walk into his or her dwelling without the excess and unwanted paper material which would usually lead to clutter.

The mailbox and the additional components that comprise the apparatus of the present invention 1, may be made of metal, durable plastic or other suitable material to ensure the structural integrity of the entire apparatus 1. In the preferred embodiment of the invention, the shredding device 10 is located on the underside of the mailbox 10, however in other embodiments, the shredding device 10 may be positioned otherwise to accommodate the size, location, or dimensions of the mailbox and the other components of the present invention 1. The shredding device 10 may comprise standard mechanical parts, including revolving or rotating blades, knives, or metal teeth, and is motorized via a circuit and/or series powered by batteries or solar energy or other viable power source known to one of ordinary skill in the art field of power sources or may become known to one of ordinary skill in the art field of power sources. Additionally, the receptacle 40 may utilize other security mechanism such as a code enabled touch pad, biometric sensors and identification features, a magnetically enable key card, a QR coded or barcoded system, or other technology known or may become known by one of ordinary skill in the art field of security.

The shredding device 10 may be removably or permanently affixed to the traditional mailbox 5, so long as it is securely attached in a manner that prevents tampering, unauthorized removal, or removal due to the elements or natural hazards. Further, the shredding device 10 may have an automatic feature whereby sensor(s) in the cutter portion 20 detect paper material and immediately begin the shredding process. The inclusion of an automatic sensor component may be in addition or alternative to the start/stop button 15 of the shredding device 10.

The present invention may be adaptable to residential buildings such as condominium or apartment complexes. The shredding device may be affixed or incorporated into a mailroom with multiple mailbox slots in a manner to accommodate individual use. Due to the number of end users and mailboxes, the number of shredding devices may also increase, or the size of the shredding device may be increased to meet the need.

As various changes may be made in the above-described subject matter without departing from the scope and the spirit of the invention, it is intended that all subject matter contained in the above description, or shown in the accompanying drawings, will be interpreted as descriptive and illustrative, and not in a limiting sense.

EQUIVALENTS

Those skilled in the art will recognize or be able to ascertain using no more than routine experimentation, many equivalents to the specific embodiments of the invention described herein. Such equivalents are intended to be encompassed by the claims.

What is claimed is:

1. An ecologically sound and environmentally friendly mailbox apparatus comprising:

a mailbox including a housing defining an interior for receiving mail and a cooperating door providing access to the interior;

a shredding device affixed to the underside of the mailbox for shredding material;

a hollow tube, having a first end and a second end;

a hollow receptacle for collecting the shredded material, and is connected to the shredding device by the hollow tube, where the first end of the hollow tube is connected to the shredding device and the second end of the hollow tube is directed downward and is connected to the receptacle; and a vertically positioned pole located adjacent to the mailbox and the receptacle, whereby the mailbox is directly connected to the pole by a first fastening device, and the receptacle is directly connected to the pole by a second fastening device, wherein the first and second fastening devices function to hold the entire apparatus together.

2. The mailbox apparatus in claim 1 made of durable plastic material.

3. The mailbox apparatus in claim 1 made of metal.

4. The mailbox apparatus in claim 1 where the receptacle has a biometric security feature.

5. The mailbox apparatus in claim 1 where the receptacle has a digitally enabled security feature.

6. The mailbox apparatus in claim 1 where the receptacle has a lock and key security feature.

7. The mailbox apparatus in claim 1 where the receptacle has a barcode enabled security feature.

8. The mailbox apparatus in claim 1 where the receptacle has a magnetically enabled card security feature.

* * * * *